US006123568A

United States Patent [19]

Bullough et al.

[11] Patent Number: 6,123,568

[45] Date of Patent: Sep. 26, 2000

[54] CABLE-ORIENTING AND SPACE SAVING CABLE CONNECTOR ASSEMBLY

[75] Inventors: Bradford Royce Bullough, Orem; Richard Dare McCloskey, Jr., Provo, both of Utah

[73] Assignee: Curtis Computer Products, Inc., Provo, Utah

[21] Appl. No.: 09/157,307

[22] Filed: Sep. 18, 1998

[51] Int. Cl.[7] ..... H01R 13/56

[52] U.S. Cl. ..... 439/445; 439/446

[58] Field of Search ..... 439/445, 446, 439/447

[56] References Cited

U.S. PATENT DOCUMENTS

| | | | |
|---|---|---|---|
| Re. 35,820 | 6/1998 | Guginsky | 174/102 R |
| D. 273,993 | 5/1984 | Schulte et al. . | |
| D. 346,790 | 5/1994 | Krehbiel . | |
| D. 374,734 | 10/1996 | Esposito | D26/43 |
| 2,869,102 | 1/1959 | Hubbell, Jr. . | |
| 3,032,740 | 5/1962 | Von Hoorn . | |
| 3,622,943 | 11/1971 | Reimer . | |
| 3,794,960 | 2/1974 | Sugar . | |
| 4,125,238 | 11/1978 | Tanaka . | |
| 4,549,780 | 10/1985 | Bertini et al. . | |
| 4,554,408 | 11/1985 | Pullen . | |
| 4,678,867 | 7/1987 | Bondard et al. | 174/135 |
| 4,830,629 | 5/1989 | Yoshimura . | |
| 4,869,686 | 9/1989 | Michaels et al. . | |
| 5,052,940 | 10/1991 | Bengal . | |
| 5,076,802 | 12/1991 | Colleran et al. . | |
| 5,195,902 | 3/1993 | Bengal . | |
| 5,271,739 | 12/1993 | Denlinger et al. . | |
| 5,300,734 | 4/1994 | Suzuki | 174/152 |
| 5,354,212 | 10/1994 | Bartle et al. . | |
| 5,385,484 | 1/1995 | Bartle et al. . | |
| 5,522,735 | 6/1996 | Wright . | |
| 5,570,443 | 10/1996 | May et al. . | |
| 5,890,926 | 4/1999 | Pauza et al. | 439/445 |

*Primary Examiner*—Paula Bradley
*Assistant Examiner*—Truc Nguyen
*Attorney, Agent, or Firm*—Pennie & Edmonds LLP

[57] ABSTRACT

A cable connector assembly having a cable terminating in a molded end and a cable-orienting device shaped and configured to bend the cable with respect to the molded end. Preferably, the cable-orienting device is in the form of a tubular body formed to maintain the cable at any desired angle and orientation with respect to the molded end. The cable-orienting device preferably is easily removable and insertable over the cable such that the cable-orienting device may be removed, or its position along the cable or orientation with respect to the cable may be adjusted. Moreover, the cable-orienting device may be rotatable once positioned over the cable to vary the orientation of the cable with respect to the molded end.

22 Claims, 1 Drawing Sheet

CABLE-ORIENTING AND SPACE SAVING CABLE CONNECTOR ASSEMBLY

FIELD OF THE INVENTION

The present invention relates to a device and method for affecting the configuration of a cable extending from a powered device. More particularly, the present invention relates to a cable connector assembly designed to permit orientation of a cable and/or to reduce the space occupied by a cable extending from a powered device.

BACKGROUND OF THE INVENTION

Cables for connecting a powered, typically electronic, device to a power source are well known. Because cables must conform to industry or technical standards to function properly, most cables are similarly designed. Such cables typically have a molded end from which an electrical connector extends. A strain relief is provided between the cable and the molded end to permit bending of the cable with respect to the molded end without damaging the wires therein. Typically, the molded end is formed from polyvinyl chlorine (PVC) molded into a desired shape.

A common design drawback of commercially available cable connectors is that conventional molds and strain reliefs are too large, bulky, and inflexible to permit the powered device to which the cable is connected to be closely positioned adjacent another object, such as a wall or another device. Such difficulties are particularly common with computer equipment. In particular, an ever increasing number of peripheral devices, such as scanners, printers, and external drivers, are being connected to computers. Thus, there is a corresponding ever increasing desire to save space and place the devices as close as possible to each other or another object, such as a wall. In addition to occupying more space, larger mold sizes commonly provided on cable connectors increase the difficulty with which an external modem or printer may be connected side by side with a mouse or other device on the same adapter card on the back of the computer.

One space saving improvement in the art of cable connector design has been the formation of connectors with right or left angled molded ends. Such molded ends are formed to maintain the cable wire extending therefrom at an angle with respect to the connector to automatically and securely direct the cable in a particular direction. However, the shape of such angled molds typically is preset and unchangeable. In the molded connector end with a cable directing tube of U.S. Pat. No. 4,830,629 to Yoshimura, although the molded end maintains the cable at a desired angle, the orientation of the cable is not readily adjusted. Accordingly, the user must know the appropriate angle direction to select and use for a given environment. If the spatial arrangement of the devices changes, a differently oriented cable connector may become necessary. Moreover, such angled molded ends are generally only available for parallel printer connectors but not for computer connectors and therefore typically do not reduce the space behind the computer itself.

Some prior art cables have partially addressed the above disadvantages by increasing the number of fixed-angles at which the cable may be maintained, such as shown in U.S. Pat. No. 3,622,943 to Reimer and U.S. Pat. No. 4,549,780 to Bertini et al. However, the benefits of these cables are limited by the limited number of preset angles in which the cable may be directed and maintained. Given the ever-increasing number of peripherals being connected to computers, such "angle-limiting" connectors do not afford the user sufficient freedom to place the peripherals at close proximity and in any angle or direction from the computer. Such connectors also limit the cable orientation only at the connector end and do not permit the maintenance of a desired orientation of the cable at other locations along the cable.

Furthermore, molded cable ends in the prior art generally embody a single housing assembly which both shields the wires connected to the electrical terminal and also performs the cable angling function. Since the molded ends either shield the entire portion of the cable that is being bent within the housing, or bend the cable around the housing, such cable-orienting molded ends are large and bulky. Consequently, such molded ends further limit the proximity with which a computer or peripheral device to which a cable with such a molded end may be positioned adjacent another object, such as a wall or another device.

SUMMARY OF THE INVENTION

In accordance with the principles of the present invention, a cable connector assembly is provided to permit the orientation of the cable thereof to be maintained in a desired direction. Additionally, the cable connector assembly may be shaped and configured to permit electronic devices coupled thereto to be positioned as close as possible to another object. The cable connector assembly of the present invention includes a cable terminating at a molded end having an insulated housing with a terminal-connecting end and a cable-connecting end. The molded end houses a connector by which the cable is coupled to a device. The cable connector assembly further includes a cable-orienting device configured to maintain the cable at a desired angle with respect to the longitudinal axis along which the cable extends from the molded end and hence from the device to which the connector is coupled. The cable-orienting device may be used to orient sections of the cable spaced from the molded end as well.

In accordance with one advantageous aspect of the invention, the cable-orienting device is shaped and configured to maintain a desired bend in the cable. Thus, the extent to which the cable extends outward, along the longitudinal axis, from the molded end may be limited to permit the device coupled thereto to be positioned close to another object. Preferably, the cable-orienting device may be detached and reattached without damaging the cable and is thus reorientable and reusable.

The housing may be formed such that its length, measured from the terminal connecting end to the cable connecting end, is less than about one inch. Such reduced length further enhances the space-serving benefit of the cable connector assembly of the present invention. Advantageously, the housing has a width that tapers toward the cable connecting end to facilitate coupling and decoupling of the connector to a device. Preferably, the cable of the cable connector device of the present invention is provided with ultra-flexible wiring that may bend and flex without sacrificing durability or shielding to further enhance the space-saving feature of the present invention.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
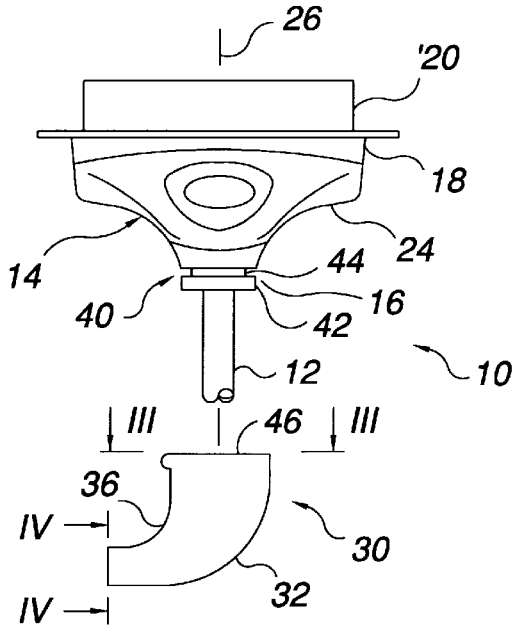
FIG. 1 is a top elevational view of a cable connector assembly formed in accordance with the principles of the present invention.
Figure 2:
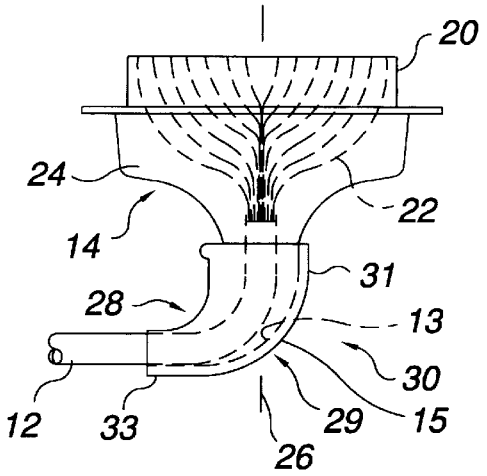
FIG. 2 is a top elevational view of the cable connector assembly of FIG. 1 with the cable-orienting device positioned on and orienting the cable.

A cable connector assembly 10 formed in accordance with the principles of the present invention is shown in FIGS. 1 and 2. Cable connector assembly 10 is configured to permit to direct cable 12 thereof as desired. The maintenance of the direction in which cable 12 extends is useful for organizational purposes (e.g., to direct cable 12 as necessary for a given workspace) as well as for space-saving purposes (e.g., to reduce the amount of space occupied by a cable extending from a device by redirecting the cable and thus limiting the distance which the cable extends outwardly from the device).

Cable connector assembly 10 includes a cable 12 terminating at a molded end 14. Molded end 14 has a cable-connecting end 16 from which cable 12 extends, and a terminal-connecting end 18 from which connector 20 extends. Connector 20 preferably is in the form of an electrical connector comprising a metal shell enclosing electrical contacts electrically isolated from each other and individually coupled to wires 22 of cable 12, as shown in phantom in FIG. 2. Wiring 22 extends from cable 12 to the contacts of connector 20 for connection, via connector 20, to a mating port or terminal block of an electrical device. Molded end 14 further includes an overmold 24 or housing which encloses wiring 22 of cable 12. At the junction of cable-connecting end 16 and cable 12, cable 12 extends along longitudinal axis 26 substantially directly outward from the electrical device to which molded end 14 and connector 20 are connected. Cable connector assembly 10 further includes a cable-orienting device 30 shaped and configured to bend cable 12 and to maintain cable 12 at a desired angle with respect to longitudinal axis 26 such that the distance which cable 12 extends from an electrical device may be reduced.

Figure 3:
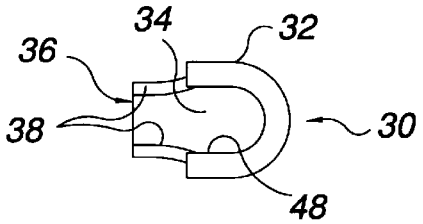
FIG. 3 is an end view along line III—III of the cable-orienting device of FIG. 1.
Figure 4:
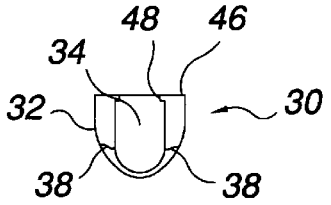
FIG. 4 is an end view along line IV—IV of the cable-orienting device of FIG. 1.

Cable connector assembly 10 is shown in an assembled configuration in FIG. 2, with cable-orienting device 30 positioned over cable 12. Cable-orienting device 30 preferably is in the form of a cable clip having a substantially tubular cable-enclosing wall 32 defining a cable-receiving channel 34 therein, as may be appreciated with reference to FIG. 3. An open side 36, such as a slot or opening, is defined in cable-enclosing wall 32 cable 12 to permit cable 12 to be inserted therethrough and into channel 34. It will be appreciated that open side 36 may be along any location about the circumference of cable clip 30 and is not limited to the location shown in the Figures. Preferably, open side 36 extends from first end 31 to second end 33 of cable clip 30 such that cable 12 may enter channel 34 by a transverse movement with respect to channel 34 and cable clip 30. First end 31 and second end 33 are preferably open and spaced apart from each other by cable-enclosing wall 32 and open side 36, as shown in FIGS. 1 and 3.

Preferably, cable clip 30 is pre-formed to form and to maintain a desired bend in cable 12. In the embodiments shown in FIGS. 1–4, cable-enclosing wall 32 has an inner arcuate surface 13 and an outer arcuate surface 15. The cable clip 30 itself may be a bent device, having an inwardly arcuate bent portion 28 and an outwardly arcuate bent portion 29, such that the device is formed with a pre-set angle. As shown in FIGS. 1 and 2, cable clip 30 is formed with a pre-set 90° angle. However, cable clip 30 may be formed with any other desired pre-set, pre-determined angle. To bend cable 12 and to maintain a corresponding bend in cable 12 over which cable clip 30 is fitted, cable clip 30 must be sufficiently rigid and strong to bend and maintain such a bend. Thus, the material of cable clip 30 should be rigid enough to bend cable 12 once cable 12 is secured within channel 34 of cable clip 30 and to maintain the bend of cable 12 for an extended period of time without spontaneously popping off cable 12. Additionally, channel 34 and open side 36 are shaped and configured, and the material of cable clip 30 is selected such that cable 12 is insertable into channel 34 past the juxtaposed ends 38 of cable-enclosing wall 32 at open side 36, yet securely maintained by the walls of cable clip 30 and within channel 34. Moreover, the material from which cable clip 30 is formed is selected to be flexible enough to permit ends 38 to flex or bend to permit cable 12 to pass through open side 36. Such flexibility permits cable clip 30 to be attached and reattached over cable 12 as desired, such as for application of cable clip 30 over a different portion of cable 12 or a different cable, or for reorientation of cable-clip 30 over cable 12. Cable clip 30 is preferably formed from a thermoplastic hard plastic or nylon such as acrylonitrile butabiene styrene (ABS), molded into a bent configuration, such as shown in FIGS. 1 and 2, to bend cable 12 and to maintain cable 12 at a desired angle with respect to longitudinal axis 26.

In accordance with the principles of the present invention, in order to bend cable 12 at a desired orientation (e.g., right or left) with regard to molded end 14, cable clip 30 is fitted over cable 12 at a desired orientation with respect to molded end 14. If the orientation is to be adjusted, cable clip 30 may be removed from cable 12 and repositioned. Alternatively, cable clip 30 may be inserted over cable 12 in any orientation and then rotated over cable 12 once cable 12 is bent by and retained within channel 34 of cable clip 30. Thus, cable clip 30 permits cable 12 to be oriented even after cable clip 30 has been positioned thereon.

In a preferred embodiment, cable clip 30 of cable connector assembly 10 is formed to be coupled to molded end 14 of cable 12. Accordingly, strain relief 40 of cable-connecting end 16 of molded end 14 is provided with a circumferential flange 42 extending about cable 12 forming receiving groove 44. Mating end 46 of cable clip 30, shown in FIG. 4, has an inwardly directed mating flange 48 which may be fitted into receiving groove 44 such that cable clip 30 may "snap" on to strain relief 40 and be coupled thereto via insertion of mating flange 48 into receiving groove 44. Cable clip 30, after being "snapped" onto strain relief 40 of molded end 14, may be removed and reoriented or rotated in any direction about longitudinal axis 26 once positioned on cable 12 to direct cable 12 in any desired direction with respect to longitudinal axis 26. Hence, the direction in which cable 12 extends from molded end 14 and an electrical device to which cable-connector assembly 10 is coupled may be adjusted as desired.

If circumferential flange 42, receiving groove 44, and mating flange 48 are not provided, preferably open side 36 is smaller and channel wall 38 is more flexible at open side 36 to permit insertion of cable 12 therethrough despite the reduced clearance size. As will be appreciated, the remainder of cable-enclosing wall 32 must be rigid enough to bend cable 12 and to maintain the desired bend despite the lack of coupling of the clip 30 to an anchoring element such as strain relief 40.

Figure 5:
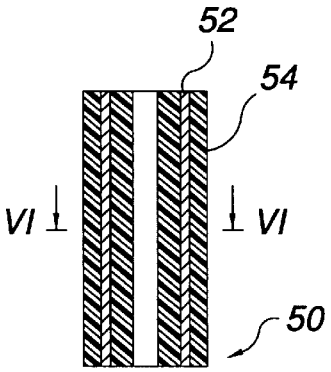
FIG. 5 is a top elevational view of another embodiment of a cable-orienting device of the present invention.
Figure 6:
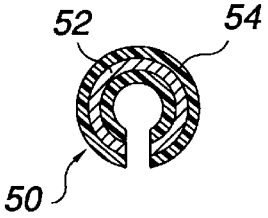
FIG. 6 is a cross-sectional view along line VI—VI of the cable-orienting device of FIG. 5.

Cable clip 30 of FIGS. 1–4 is formed to bend cable 12 and maintain cable 12 at a predetermined angle with respect to longitudinal axis 26. If desired, the cable clip of cable-connection assembly may be configured to permit cable 12 to be bent at any desired angle with respect to longitudinal axis 26. Another preferred embodiment of a cable clip which may be used with the cable connector assembly 10 is shown in FIGS. 5 and 6. Cable clip 50 is formed from a flexible, bendable structure 52 preferably enclosed by a protective covering 54. Structure 52 permits bending of cable 12 even after cable clip 50 is inserted over cable 12, thus directing cable 12 at any desired angle with respect to longitudinal axis 26 and in a desired direction.

The material from which structure 52 is formed thus should be bendable into a desired orientation, yet sturdy enough to maintain the desired bend in cable 12 once positioned on cable 12 and bent in the desired direction. For example, structure 52 may be a bendable metal capable of maintaining a bend incorporated thereto, such as soft steel, copper, or aluminum. Protective covering 54 encloses structure 52, as may be appreciated with reference to the cross-sectional view of FIG. 6, to protect cable 12 from any damage which otherwise may occur by bending structure 52. Protective covering 54 preferably is formed from a cushioning, resilient, elastomeric material such as polyvinyl chloride (PVC).

Figure 7:
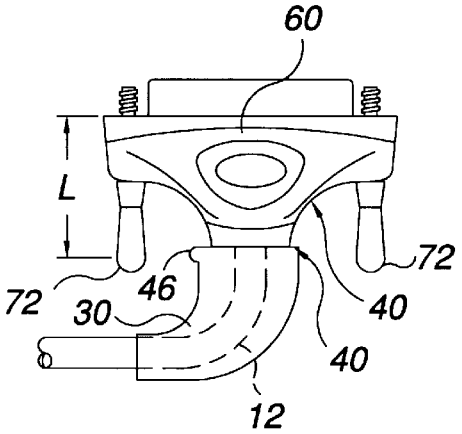
FIG. 7 is a top elevational view of a cable connector assembly molded end with thumbscrews formed in accordance with the principles of the present invention.

Referring again to FIGS. 1 and 2, a preferred embodiment of molded end 14 is formed to be as compact as possible to further reduce the space occupied by cable connector assembly 10 extending from an electrical device. Preferably, molded end 14 extends less than about one inch from the electrical device to which cable connection assembly 10 is coupled. Additionally, cable 12 of cable connector assembly 10 comprises ultra-flexible wiring which permits increased bendability and flexibility without sacrificing durability and shielding such that the distance cable 12 extends from an electrical device to which cable 12 is coupled is further minimized. Preferably, at least a portion of one or more sides of the molded end 14 is textured, such as with bumps 60 and molded end 14 is shaped, such as with a taper, to enhance gripping of molded end 14. If desired, thumbscrews 62, shaped for enhanced gripping, may be provided, as shown in FIG. 7.

While the foregoing description and drawings represent the preferred embodiments of the present invention, it will be understood that various additions and/or substitutions may be made therein without departing from the spirit and scope of the present invention as defined in the accompanying claims. One skilled in the art will appreciate that the invention may be used with many modifications of structure, forms, arrangement, proportions, materials, and components and otherwise, used in the practice of the invention and which are particularly adapted to specific environments and operative requirements, without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A cable connector assembly comprising:

a cable terminating in a molded end; and a bent cable-orienting device formed separately from said cable and molded end, said cable-orienting device having a cable-receiving channel and being configured to bend a cable received in said cable-receiving channel and to maintain the bend in said cable.

2. The cable connector assembly of claim 1, wherein said cable-enclosing wall is substantially tubular.

3. The cable connector assembly of claim 2, wherein said cable-orienting device has a first end, a second end, and an open side extending from said first end to said second end to permit insertion of said cable into said cable-receiving channel through said open side.

4. The cable connector assembly of claim 2, wherein said cable-orienting device is pre-formed into a bent configuration.

5. The cable connector assembly of claim 1, wherein:

said molded end houses a connector;

said molded end has a cable-connecting end adjacent said cable and a terminal-connecting end adjacent said connector; and said molded end and said cable-orienting device are shaped to be coupled together.

6. The cable connector assembly of claim 5, wherein:

said molded end includes a circumferential flange defining a receiving groove; and said cable-orienting device includes an inwardly directed mating flange shaped to be received within said receiving groove.

7. The cable connector assembly of claim 6, wherein said molded end further includes a strain relief adjacent said cable-connecting end, said circumferential flange and receiving groove being formed in said strain relief.

8. The cable connector assembly of claim 6, wherein said receiving groove and said mating flange fit together to couple said cable-orienting device to said molded end and to permit rotation of said cable-orienting device about said cable after said cable-orienting device has been coupled to said molded end.

9. A cable-orienting device having a first open end, a second open end spaced apart from said first open end, and a cable-enclosing wall spacing said first and second open ends apart and defining a cable-receiving channel shaped to receive and enclose a cable, wherein:

an open side is defined in said cable-enclosing wall extending from said first open end to said second open end and spacing said first and second open ends apart; and said cable-receiving channel is shaped and configured such that said cable-enclosing wall securely maintains the cable within said cable-receiving channel.

10. The cable-orienting device of claim 9, wherein said cable-enclosing wall is substantially tubular and is bent into a predetermined angle.

11. The cable-orienting device of claim 10, wherein said cable-orienting device is molded to form said channel walls into said predetermined angle.

12. The cable-orienting device of claim 9, wherein said side opening is configured to permit a cable to be inserted transversely across said cable-enclosing wall and into said cable-receiving channel.

13. A method of orienting a cable with respect to a molded end of said cable, said molded having a cable-connecting end and a terminal connecting end, said method comprising the steps of:

providing a cable-orienting device comprising a cable-enclosing wall defining a bent cable-receiving channel;

positioning said cable-orienting device over said cable and over the molded end of the cable such that the cable is received within said cable-receiving channel and bent by said cable-receiving channel.

14. The method of claim 13, wherein said cable-orienting device is formed with a pre-set bend, said method further comprising the step of rotating said cable-orienting device over the cable to vary the orientation of the cable with respect to the molded end.

15. The method of claim 13, wherein said cable-orienting device is formed from a bendable material capable of maintaining a bend set therein, said method further comprising the step of bending said cable-orienting device over the cable to vary the orientation of the cable with respect to the molded end.

16. The method of claim 13, further comprising the step of removing said cable-orienting device from a first cable and positioning said cable-orienting device over a second cable.

17. The method of claim 13, further comprising the step of coupling said cable-orienting device to the molded end of the cable;

wherein:

the molded end of said cable defines a groove;

the cable-orienting device defines a flange; and said step of coupling comprises the step of inserting said flange into said groove.

18. A cable-orienting device comprising a cable-enclosing wall defining a cable-receiving channel therein, wherein:

said cable-enclosing wall has an inner arcuate surface and an outer arcuate surface;

said cable-orienting device is molded into a bent configuration imparting a bend to said cable-orienting device shaped to maintain a corresponding bend in a cable inserted therein;

said bent cable-orienting device has first and second spaced apart ends, an outwardly arcuate bent portion between said first and second spaced apart ends, and an inwardly arcuate bent portion between said first and second spaced apart ends; and an open side is defined in said cable-enclosing wall along said inwardly arcuate bent portion of said cable-orienting device.

19. The cable orienting device of claim 18, wherein said cable-orienting device is formed from a thermoplastic hard plastic or nylon molded into said bent configuration.

20. A cable-orienting device as in claim 18, wherein said cable-enclosing wall is a substantially tubular wall bent to impart said bent configuration.

21. The method as claimed in claim 13, further comprising the step of adjusting the orientation of said cable-orienting device once said cable is received within said cable-receiving channel to vary the orientation of the cable with respect to the molded end.

22. The method as claimed in claim 13, wherein said step of positioning said cable-orienting device over said cable further comprises the step of inserting the cable into said cable-receiving channel by a transverse movement with respect to said channel.

* * * * *